US008955606B2

(12) United States Patent
O'Malley

(10) Patent No.: US 8,955,606 B2
(45) Date of Patent: Feb. 17, 2015

(54) SEALING DEVICES FOR SEALING INNER WALL SURFACES OF A WELLBORE AND METHODS OF INSTALLING SAME IN A WELLBORE

(75) Inventor: Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 342 days.

(21) Appl. No.: 13/152,346

(22) Filed: Jun. 3, 2011

(65) Prior Publication Data

US 2012/0305253 A1 Dec. 6, 2012

(51) Int. Cl.
*E21B 33/12* (2006.01)
*E21B 43/10* (2006.01)

(52) U.S. Cl.
CPC ..... *E21B 43/103* (2013.01); *E21B 43/105* (2013.01)
USPC ..... 166/386; 166/387; 166/123; 166/181; 166/101

(58) Field of Classification Search
CPC . E21B 43/103; E21B 33/1208; E21B 43/105; E21B 33/12; E21B 33/127; E21B 23/06; E21B 43/108; E21B 33/1285
See application file for complete search history.

(56) References Cited

U.S. PATENT DOCUMENTS

| | | | |
|---|---|---|---|
| 927,874 | A | 7/1909 | Robinson |
| 2,069,212 | A | 2/1937 | Buffington |
| 2,196,668 | A | 4/1940 | Ragan |
| 2,289,164 | A | 7/1942 | Arnold et al. |
| 2,330,425 | A | 9/1943 | Hilton |
| 2,464,713 | A | 3/1949 | Penick |
| 2,467,822 | A | 4/1949 | Griffin et al. |
| 2,604,946 | A | 7/1952 | Sweet |
| 2,720,267 | A | 10/1955 | Brown |
| 2,743,781 | A | 5/1956 | Lane |
| 2,789,004 | A | 4/1957 | Foster |
| 2,812,025 | A | 11/1957 | Teague et al. |

(Continued)

FOREIGN PATENT DOCUMENTS

| | | | |
|---|---|---|---|
| GB | 2230800 | A | 10/1990 |
| GB | 2 406 593 | A | 4/2005 |

(Continued)

OTHER PUBLICATIONS

J.D. Burley, et al., Recent Developments in Packer Seal Systems for Sour Oil and Gas Wells, Oct. 9-12, 1977, pp. 1-8, SPE 6762, American Institute of Mining, Metallurgical, and Petroleum Engineers, Inc., U.S.A.

(Continued)

*Primary Examiner* — Jennifer H Gay
*Assistant Examiner* — Caroline Butcher
(74) *Attorney, Agent, or Firm* — Shawn Hunter

(57) ABSTRACT

Sealing devices for use in a wellbore to seal a leak path through an inner wall surface of the wellbore comprise a mandrel, an expandable element, and a shape deforming sealing element. Expansion or inflation of the expandable element moves the shape deforming sealing element from its run-in shape to its set shape. A stimulus, such as a change in temperature, acts upon the shape deforming sealing element facilitating the shape deforming sealing element changing shape. Removal of the stimulus causes the shape deforming sealing element to remain in the set shape. Thereafter, the mandrel and expandable element can be removed to leave only the shape deforming sealing element within the wellbore to seal the leak path.

18 Claims, 6 Drawing Sheets

(56) References Cited

U.S. PATENT DOCUMENTS 2,880,806 A 4/1959 Davis
2,970,651 A 2/1961 Roberts
3,036,639 A 5/1962 Baker
3,085,627 A 4/1963 Sodich
3,171,492 A 3/1965 Cochran
3,268,275 A 8/1966 Laughlin
3,364,993 A * 1/1968 Skipper ..... 166/250.08
3,436,084 A 4/1969 Courter
3,554,280 A 1/1971 Tucker
3,926,254 A 12/1975 Evans et al.
3,952,656 A 4/1976 Fox et al.
4,258,926 A 3/1981 Upton
4,285,400 A 8/1981 Mullins, II
4,313,495 A 2/1982 Brandell
4,441,551 A 4/1984 Biffle
4,452,463 A 6/1984 Buckner
4,458,752 A 7/1984 Brandell
4,469,172 A 9/1984 Clark
4,488,740 A 12/1984 Baugh et al.
4,515,213 A * 5/1985 Rogen et al. ..... 166/123
4,573,537 A 3/1986 Hirasuna et al.
4,615,544 A 10/1986 Baugh
4,685,516 A 8/1987 Smith et al.
4,706,746 A 11/1987 White et al.
4,729,430 A 3/1988 White et al.
4,787,446 A 11/1988 Howell et al.
4,793,424 A 12/1988 Lim, Jr.
4,877,086 A 10/1989 Zunkel
4,900,067 A 2/1990 Jansen et al.
5,097,902 A 3/1992 Clark
5,193,616 A 3/1993 Hynes
5,203,412 A 4/1993 Doggett
5,207,272 A 5/1993 Pringle et al.
5,220,959 A 6/1993 Vance, Sr.
5,236,047 A 8/1993 Pringle et al.
5,257,663 A 11/1993 Pringle et al.
5,291,947 A 3/1994 Stracke
5,320,182 A 6/1994 Mendez
5,327,962 A 7/1994 Head
5,343,963 A 9/1994 Bouldin et al.
5,466,537 A 11/1995 Diede et al.
5,540,280 A 7/1996 Schultz et al.
5,542,473 A 8/1996 Pringle
5,577,560 A 11/1996 Coronado et al.
5,613,557 A 3/1997 Blount et al.
5,701,959 A 12/1997 Hushbeck et al.
5,833,001 A 11/1998 Song et al.
5,849,188 A 12/1998 Voll et al.
5,849,198 A 12/1998 Sharpless
5,936,913 A 8/1999 Gill et al.
5,975,205 A 11/1999 Carisella
6,006,835 A 12/1999 Onan et al.
6,009,951 A 1/2000 Coronado et al.
6,055,213 A 4/2000 Rubbo et al.
6,102,117 A 8/2000 Swor et al.
6,102,120 A 8/2000 Chen et al.
6,142,227 A 11/2000 Hiorth et al.
6,173,788 B1 1/2001 Lembcke et al.
6,173,969 B1 1/2001 Stool et al.
6,203,020 B1 3/2001 Mireles, Jr. et al.
6,341,654 B1 1/2002 Wilson et al.
6,343,796 B1 2/2002 Lee et al.
6,361,049 B1 3/2002 Joco
6,390,479 B1 5/2002 Combet et al.
6,431,273 B1 8/2002 McGarian et al.
6,497,416 B1 12/2002 Morvant
6,571,876 B2 6/2003 Szarka
6,626,243 B1 9/2003 Go Boncan
6,712,153 B2 3/2004 Turley et al.
6,769,491 B2 8/2004 Zimmerman et al.
6,772,844 B2 8/2004 Lloyd et al.
6,779,601 B2 8/2004 Wilson et al.
6,798,350 B2 9/2004 Maxit et al.
6,834,725 B2 12/2004 Whanger et al.
6,843,315 B2 1/2005 Coronado et al.
6,843,480 B2 1/2005 Nelson et al.
6,854,522 B2 2/2005 Brezinski et al.
6,962,206 B2 11/2005 Hirth et al.
7,165,622 B2 1/2007 Hirth et al.
7,188,691 B2 3/2007 Yong et al.
7,204,525 B2 4/2007 Matzner
7,210,533 B2 5/2007 Starr et al.
7,213,814 B2 5/2007 Hurlbert et al.
7,322,410 B2 1/2008 Vinegar et al.
7,331,581 B2 2/2008 Xu et al.
7,363,970 B2 4/2008 Corre et al.
7,387,165 B2 6/2008 Lopez de Cardenas et al.
7,448,445 B2 11/2008 Doane et al.
7,478,679 B2 1/2009 Berzin et al.
7,610,964 B2 11/2009 Cox
7,617,880 B2 11/2009 Loughlin
7,703,542 B2 4/2010 O'Connor et al.
7,726,407 B2 6/2010 Wood et al.
7,743,835 B2 * 6/2010 Willauer ..... 166/387
7,748,468 B2 7/2010 Casciaro
7,806,177 B2 10/2010 Bishop et al.
7,806,192 B2 10/2010 Foster et al.
7,806,193 B2 10/2010 Berzin et al.
7,845,402 B2 12/2010 O'Connor et al.
7,886,818 B1 2/2011 O'Connor et al.
7,891,433 B2 2/2011 Vinson et al.
7,931,093 B2 4/2011 Foster et al.
7,938,192 B2 5/2011 Rytlewski
8,016,295 B2 9/2011 Guest et al.
8,037,942 B2 10/2011 Vinson et al.
2003/0080515 A1 5/2003 Milberger et al.
2003/0131988 A1 7/2003 Wilson et al.
2004/0112609 A1 6/2004 Whanger et al.
2004/0129432 A1 7/2004 Wills et al.
2004/0134659 A1 7/2004 Hoffman et al.
2005/0023003 A1 2/2005 Echols et al.
2005/0161229 A1 7/2005 Doane et al.
2005/0199401 A1 9/2005 Patel et al.
2005/0284633 A1 12/2005 Richard
2006/0124310 A1 6/2006 Lopez de Cardenas et al.
2006/0186602 A1 8/2006 Martin et al.
2007/0039160 A1 2/2007 Turley et al.
2007/0056725 A1 3/2007 Lucas et al.
2007/0125532 A1 6/2007 Murray et al.
2007/0144734 A1 6/2007 Xu et al.
2007/0193736 A1 8/2007 Corre et al.
2007/0289749 A1 12/2007 Wood et al.
2007/0290454 A1 12/2007 Garrison et al.
2008/0087417 A1 4/2008 Doane et al.
2008/0110625 A1 5/2008 Arcement et al.
2008/0135260 A1 6/2008 Berzin et al.
2008/0149351 A1 6/2008 Marya et al.
2008/0156501 A1 7/2008 Vinson et al.
2008/0264647 A1 * 10/2008 Li ..... 166/373
2008/0283236 A1 11/2008 Akers et al.
2008/0302543 A1 12/2008 O'Connor et al.
2009/0126947 A1 5/2009 King
2009/0139707 A1 6/2009 Berzin et al.
2009/0173490 A1 7/2009 Dusterhoft et al.
2009/0211767 A1 8/2009 Nutley et al.
2009/0211770 A1 8/2009 Nutley et al.
2009/0242214 A1 10/2009 Foster et al.
2009/0255675 A1 10/2009 Casciaro
2009/0255690 A1 10/2009 Conner et al.
2009/0308656 A1 12/2009 Chitwood et al.
2010/0071908 A1 3/2010 Bishop et al.
2010/0078180 A1 4/2010 O'Connor et al.
2010/0155050 A1 6/2010 Frazier
2010/0230094 A1 9/2010 Foster et al.
2010/0230902 A1 9/2010 Castillo et al.
2011/0005778 A1 1/2011 Foster et al.
2011/0036560 A1 2/2011 Vail, III et al.
2011/0036561 A1 2/2011 Bishop et al.
2011/0259587 A1 * 10/2011 Joseph et al. ..... 166/277
2012/0037355 A1 2/2012 Bishop et al.
2012/0067564 A1 3/2012 Mack et al.

(56) References Cited

U.S. PATENT DOCUMENTS

| | | | |
|---|---|---|---|
| 2012/0119445 | A1 | 5/2012 | Castillo et al. |
| 2012/0312559 | A1 | 12/2012 | Bailey et al. |

FOREIGN PATENT DOCUMENTS

| | | | |
|---|---|---|---|
| WO | WO 86/02971 | | 5/1986 |
| WO | WO 95/23908 | | 9/1995 |
| WO | WO 2010127240 | A1 * | 11/2010 |

OTHER PUBLICATIONS

D.D. Onan, et al., Elastomeric Composites for Use in Well Cementing Operations, Oct. 3-6, 1993, pp. 593-608, SPE 26572, Society of Petroleum Engineers, Inc., U.S.A.

Thomas W. Ray, High Pressure/High Temperature (HP/HT) Seals for Oil and Gas Production, Feb. 17-19, 1998, pp. 603-614, SPE 39573, Society of Petroleum Engineers, Inc., U.S.A.

Product Report, ZXP Compression Set Liner Packer, Sep. 2001, Baker Hughes Incorporated, Houston, Texas, USA.

Gordon MacKenzie, et al., Wellbore Isolation Intervention Devices Utilizing a Metal-to-Metal Rather Than an Elastomeric Sealing Methodology, Nov. 11-14, 2007, pp. 1-5, SPE 109791, Society of Petroleum Engineers, Inc., U.S.A.

S. Yakeley, et al., Swellable Packers for Well Fracturing and Stimulation, Nov. 11, 2007, pp. 1-7, SPE 110621, Society of Petroleum Engineers, U.S.A.

King, George E., Permanent and Retrievable Packer Removal, Mar. 14, 2009, pp. 1-35, George E. King Engineering, Inc., USA.

* cited by examiner

SEALING DEVICES FOR SEALING INNER WALL SURFACES OF A WELLBORE AND METHODS OF INSTALLING SAME IN A WELLBORE

BACKGROUND

1. Field of Invention

The invention is directed to sealing devices for sealing a leak path through an inner wall surface of a wellbore and, in particular, to sealing devices having a shape deforming element that can be moved from a run-in shape to a set shape in which the sealing device is secured to the inner wall surface of the wellbore.

2. Description of Art

In subterranean wellbores, undesirable flow paths can occur. These may be the result of existing fractures present in the formation or occurring after some time, or they may be holes or perforations in the well casing or tubing that intersect a formation that is either taking fluid or producing an undesirable fluid (such as water). One way address these issues is to seal off portions of a wellbore containing the undesirable flow paths such as by disposing plugs, packers, or other sealing elements within the wellbore above and below the fractures. Because the zone comprising the fracture is isolated by the packers or other sealing devices, access to the region below the isolated section can be denied or geometrically limited by the bore in packer.

SUMMARY OF INVENTION

Broadly, sealing devices for use in a wellbore to seal a leak path through an inner wall surface of the wellbore are disclosed. In one specific embodiment, the sealing device comprises a tubular member or mandrel, an expandable element, and a shape deforming sealing element. Expansion or inflation of the expandable element moves the shape deforming sealing element from its run-in shape to its set shape. A stimulus, such as a change in temperature, acts upon the shape deforming sealing element facilitating the shape deforming sealing element changing shape. Removal of the stimulus causes the shape deforming sealing element to remain in the set shape. Thereafter, the mandrel and expandable element can be removed to leave only the shape deforming sealing element within the wellbore to seal the leak path.

Figure 1:
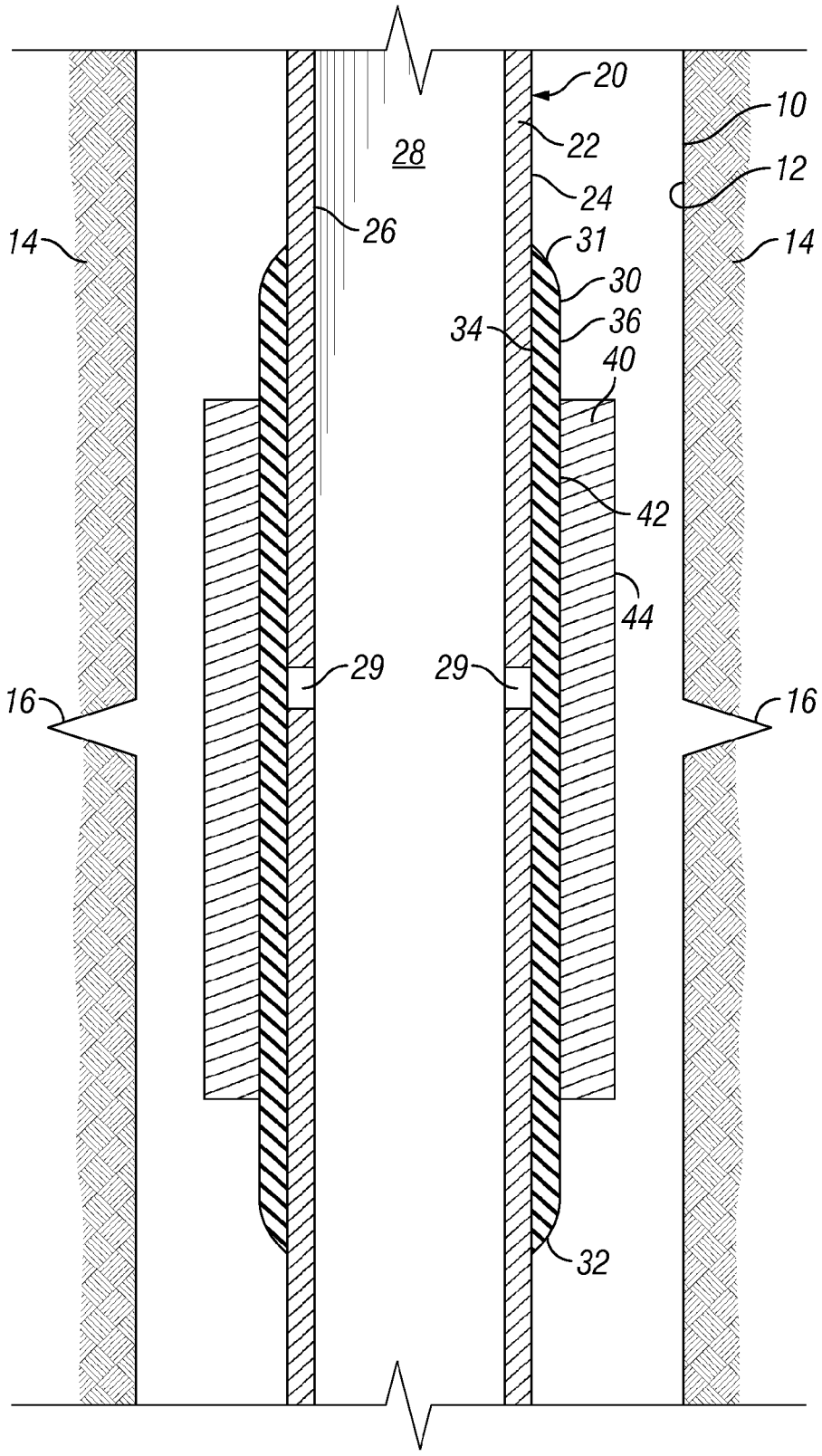
FIG. 1 is a cross-sectional view of one specific embodiment of a sealing device shown with an expandable element in a collapsed position and a shape deforming sealing element in a run-in shape.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1-4, wellbore 10 is disposed in formation 14. Wellbore 10 comprises inner wall surface 12. Disposed in inner wall surface 12 is leak path 16. Wellbore 10 can be an open-hole wellbore or a cased wellbore. Thus, as used herein, the term "wellbore" is given its broadest meaning to include both open-hole wells or wellbores and cased wells or wellbores.

One embodiment of the sealing devices disclosed herein is shown with reference to FIGS. 1-4. Sealing device 20 comprises tubular member or mandrel 22 having outer wall surface 24 and inner wall surface 26 defining bore 28. One or more ports 29 are disposed in mandrel 22 placing bore 28 in fluid communication with outer wall surface 24.

Disposed along outer wall surface 24 of mandrel 22 is expandable element 30. Expandable element 30 may be formed of an elastomeric material or any other material that facilitates radial expansion of expandable element 30. In one particular embodiment, expandable element 30 is an inflatable element, such as a bladder, having interior area 38 for receiving a fluid to cause expansion or inflation. In these embodiments, ports 29 are in fluid communication with interior area 38 so that a fluid pumped down bore 28 can enter interior area 38 and expand expandable element 30.

Figure 2:
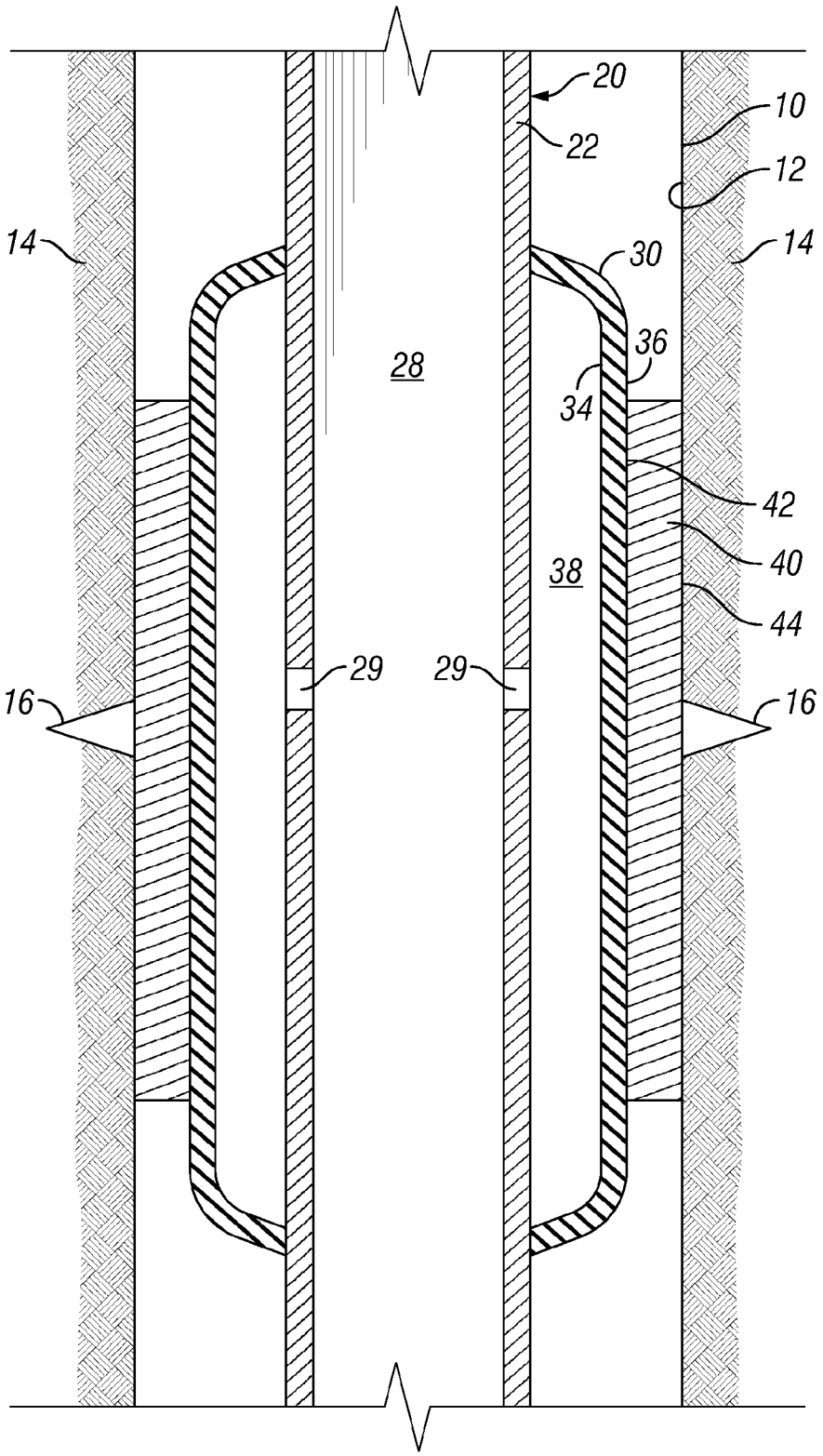
FIG. 2 is a cross-sectional view of the sealing device of FIG. 1 shown with the expandable element in a partially expanded position and the shape deforming sealing element in the run-in shape.
Figure 3:
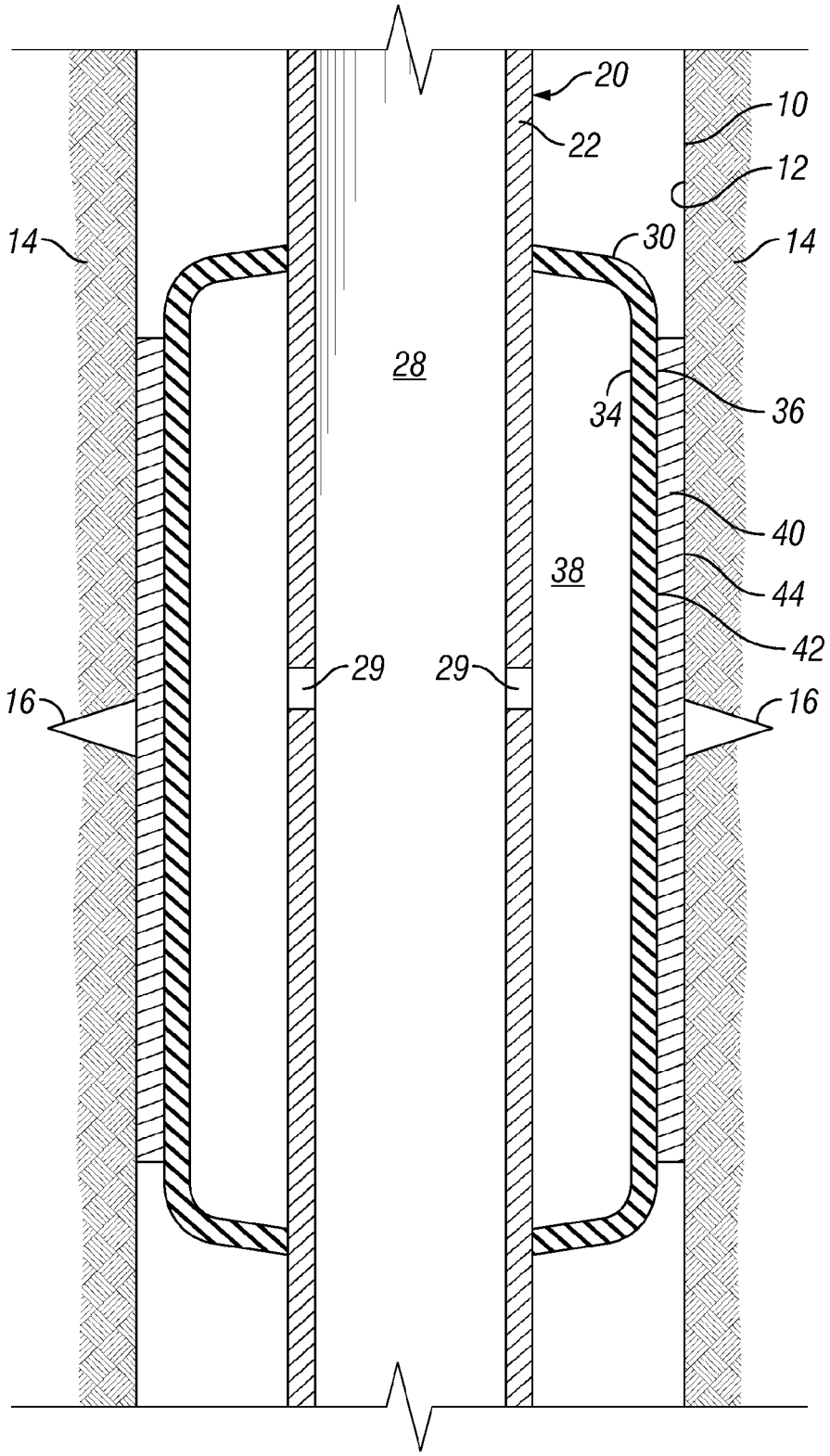
FIG. 3 is a cross-sectional view of the sealing device of FIG. 1 shown with the expandable element in an expanded position and the shape deforming sealing element in a set shape.

Expandable element 30 comprises upper end 31, lower end 32, inner wall surface 34, outer wall surface 36, and interior area 38 (FIGS. 2-3). In the embodiment shown in FIGS. 1-4, expandable element 30 is secured to outer wall surface 24 of mandrel 20 at upper and lower ends 31, 32. Securing upper and lower ends 31, 32 to mandrel 20 can be accomplished through any device or method known in the art. As discussed in greater detail below, expandable element 30 comprises a first or run-in position (FIG. 1), an expanded position (shown in FIG. 3), and one or more intermediate positions, one of which is shown in FIG. 2.

Releasably attached to outer wall surface 36 of expandable element 30 is shape deforming sealing element 40. Shape deforming sealing element 40 comprises inner wall surface 42 and outer wall surface 44. Inner wall surface 42 is operatively associated with outer wall surface 36 of expandable element 30 so that upon being disposed in the set position (discussed in greater detail below), shape deforming sealing element 40 will be released from outer wall surface 36 of expandable element 30 so that shape deforming sealing element 40 can be left within the wellbore 10 when mandrel 20 is removed.

Outer wall surface 44 of shape deforming sealing element 40 is adapted to be secured to inner wall surface 12 of wellbore 10 when shape deforming sealing element 40 is in the set position so that leak path 16 will be sealed.

In one particular embodiment, shape deforming sealing element 40 comprises a high temperature shape memory polymer. These types of materials change shape upon being heated to the material's transition temperature. Upon reaching the transition temperature, the materials deform automatically, or with the assistance of some other stimulus, e.g., force, so that the material takes another shape such as by returning to its natural or "memorized" shape. Suitable high temperature shape memory polymers include polyurethane. Alternatively, shape deforming sealing element 40 can comprise curable elastomers such as nitrile rubber, EPDM, and perfluroelastomers. Curable elastomers are those that can be deformed into another shape and that other shape can be maintained.

As illustrated in the embodiment of FIGS. 1-4, expandable element 30 and shape deforming sealing element 40 both comprise sleeves having variable inner diameters.

As shown in FIGS. 2-3, fluid (not shown) is pumped down bore 28 of mandrel 22 and through ports 29 into interior area 38 of expandable element 30 causing expandable element 30 to radially expand. In so doing, shape deforming sealing element 40 also radially expands until outer wall surface 44 engages inner wall surface 12 of wellbore 10 (FIG. 10). Additional fluid is pumped down bore 28 of mandrel 22 and through ports 29 into interior area 38 of expandable element 30 causing expandable element 30 to further radially expand and deform shape deforming sealing element 40 from the run-in shape (shown in FIGS. 1-2) to the set shape (shown in FIGS. 3-4). In so doing, leak path 16 is sealed by shape deforming sealing element 40. Thereafter, fluid pressure within interior area 38 of expandable element 30 is relieved causing expandable element 30 to collapse or return toward its run-in position. At this point, sealing device 20 can be removed from wellbore 10. In so doing, shape deforming sealing element 40 remains in place within wellbore 10 sealing leak path 16, yet permitting additional downhole tools to be performed below shape deforming sealing element 40. Because only shape deforming sealing element 40 remains in the wellbore, more of the inner diameter of wellbore 10 is unrestricted so that more downhole operations can be performed. For example, additional shape deforming sealing elements (not shown) can be run-in wellbore 10 below shape deforming sealing element 40 so that additional leak paths (not shown) can be sealed.

Figure 4:
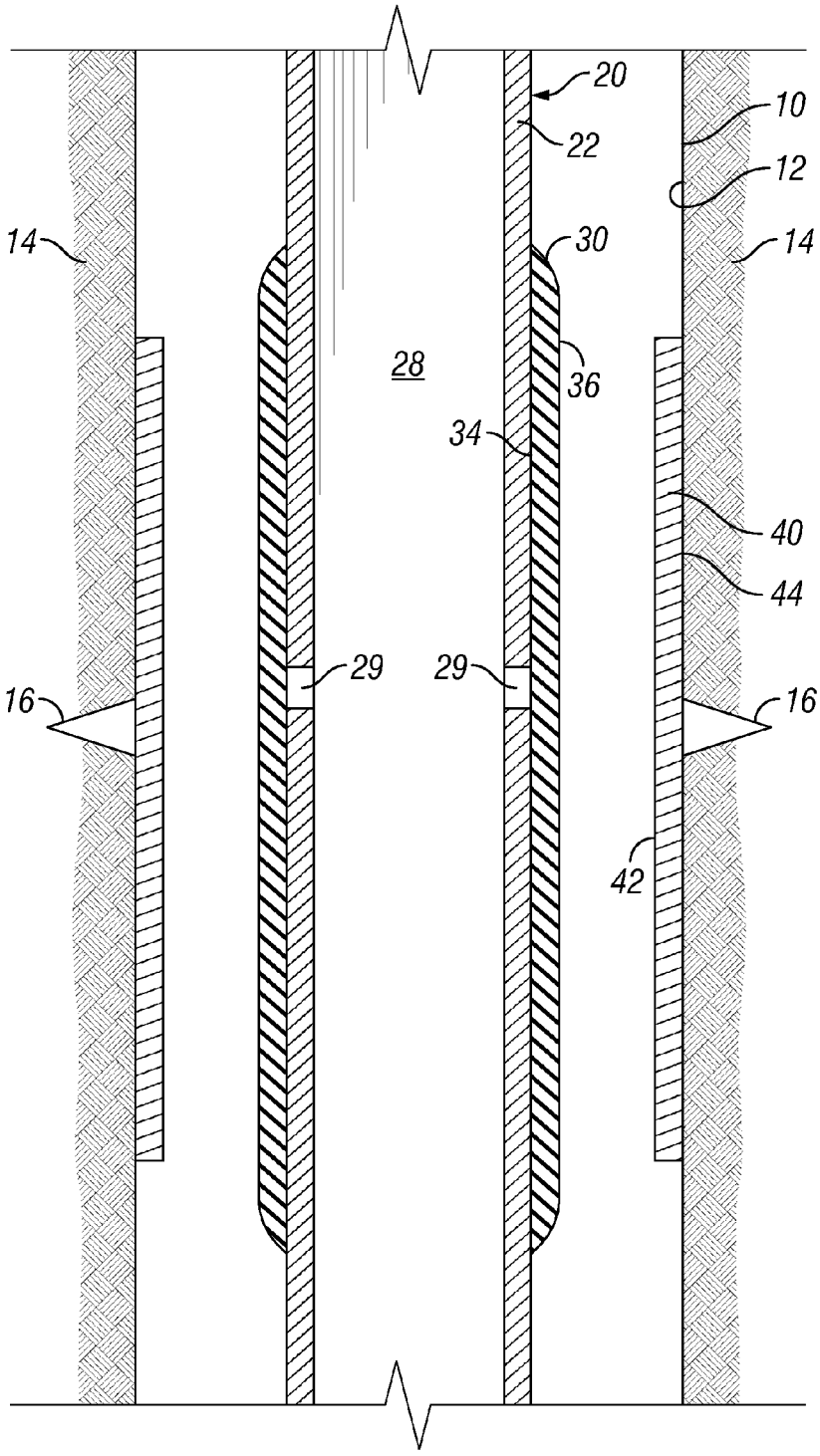
FIG. 4 is a cross-sectional view of the sealing device of FIG. 1 shown with the expandable element in the collapsed position and the shape deforming sealing element in a set shape.

In one particular embodiment of the method of sealing leak path 16 using sealing device 20 shown in FIGS. 1-4, the fluid used to expand expandable element 30 is wellbore fluid disposed within wellbore 10. In another specific embodiment, the fluid is heated to a temperature at which shape deforming sealing element 40 is deformable from the run-in shape (FIGS. 1-2) to the set shape (FIGS. 3-4). In still another embodiment, prior to collapsing or deflating expandable element 30 after shape deforming sealing element 40 is disposed in the set shape, the fluid in interior area 38 can be cooled to a lower temperature thereby causing shape deforming sealing element 40 to remain in the set shape. Moreover, expandable element 30 can be expanded from the collapsed position to the expanded position using known inflation methods, whether on wireline or tubing strings.

Figure 5:
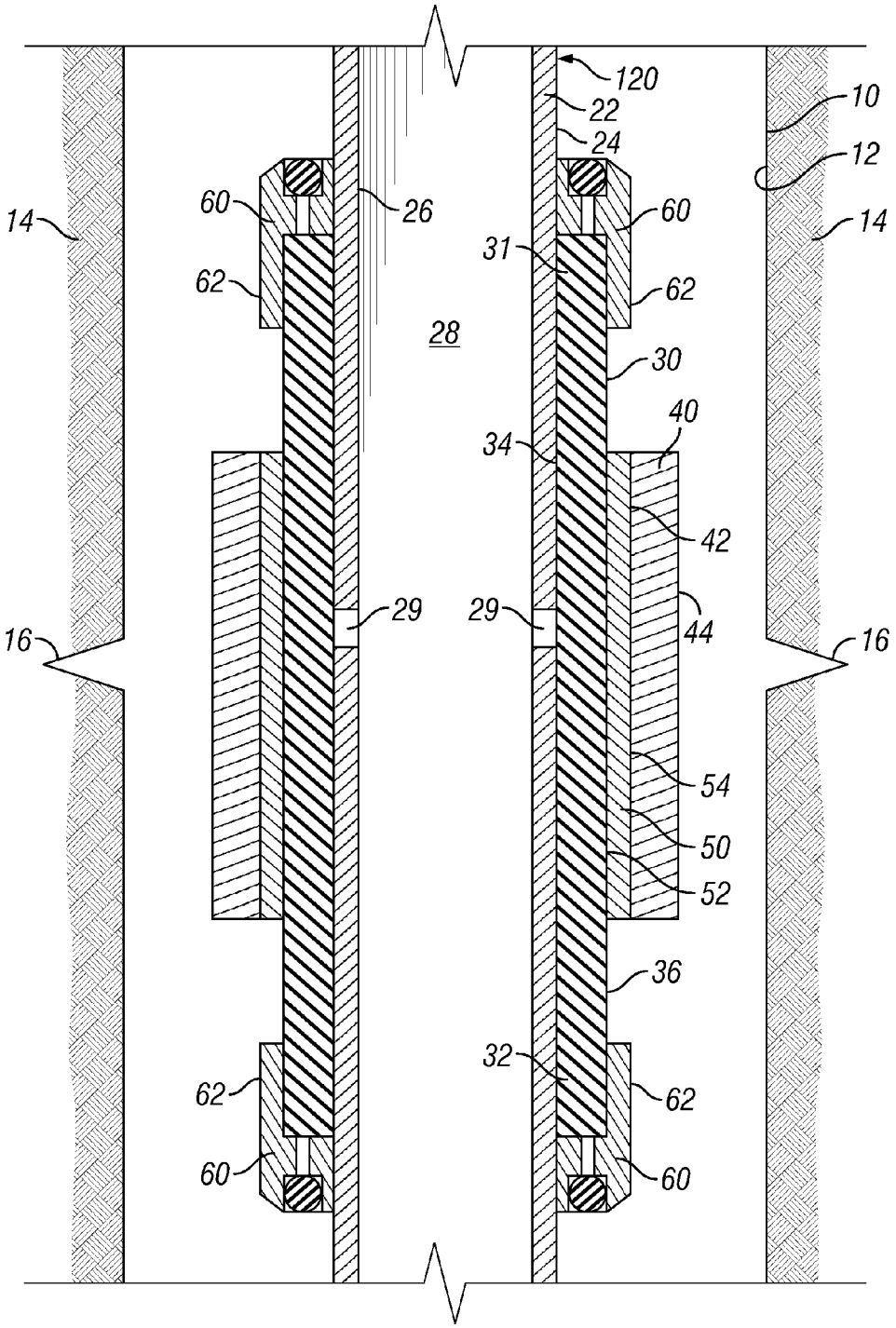
FIG. 5 is a cross-sectional view of another specific embodiment of a sealing device shown with an expandable element in a collapsed position and a shape deforming sealing element in a run-in shape.
Figure 6:
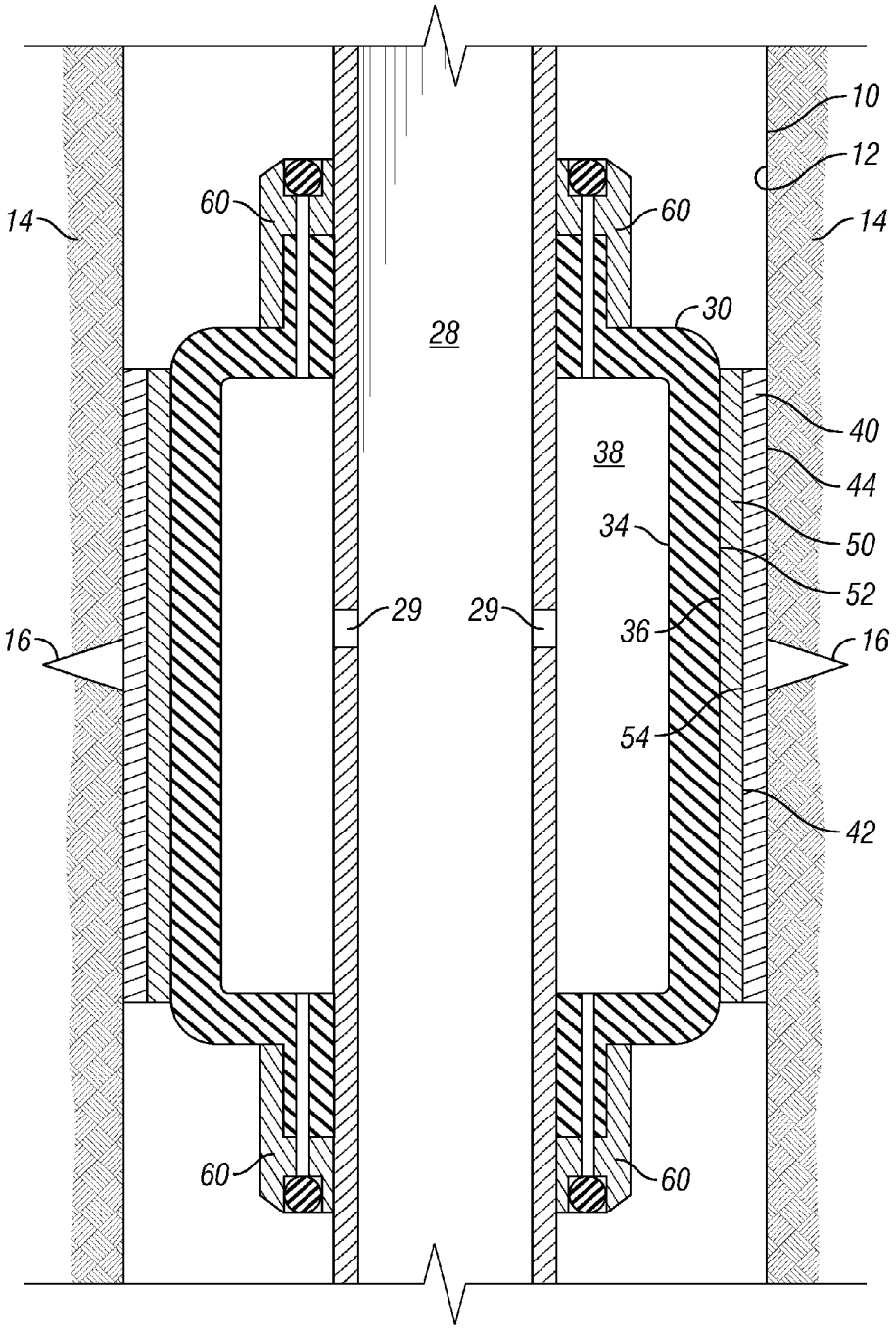
FIG. 6 is a cross-sectional view of one specific embodiment of a sealing device shown with the expandable element in an expanded position and a shape deforming sealing element in a set shape.

Referring now to FIGS. 5-6, in another embodiment, sealing device 120, having the same components as the embodiment of FIGS. 1-4 and, thus, like reference numerals, further comprises support sleeve 50 and one or more pressure relief devices 60 operatively associated with interior area 38 of expandable element 30. As shown in the embodiment of FIGS. 5-6, four pressure relief devices 60 are disposed in fluid communication with interior area 38 of expandable element 30. Pressure relief devices 60 are shown is one-way check valves, although pressure relief devices 60 can be any known pressure relief devices. In the embodiment of FIGS. 5-6, pressure relief devices 60 include flange portions 62 that facilitate attaching first and second ends 31, 32 to outer wall surface 24 of mandrel 22.

Support sleeve 50 comprises an expandable tubular member having inner wall surface 52 operatively associated with outer wall surface 36 of expandable element 30 and outer wall surface 54 operatively associated with inner wall surface 42 of shape deforming sealing element 40. Support sleeve 50 expands with shape deforming sealing element 40 and, after shape deforming sealing element 40 is placed in the set shape, support sleeve is released from expandable element 30 so that shape deforming sealing element 40 and support sleeve 50 are left in wellbore 10. As a result, support sleeve 50 provides mechanical back-up to shape deforming sealing element 40 to facilitate maintaining shape deforming sealing element 40 in the set position and in sealing engagement with inner wall surface 12 of wellbore 10. In one embodiment, support sleeve comprises a slotted tubular member formed of a high temperature polymer or metallic material.

Operation of the embodiment of FIGS. 4-5 is similar to the embodiment of FIGS. 1-2, however, the fluid flowing into interior area 38 for expansion or inflation of expandable element 30 is permitted to flow out of interior area 38 through pressure relief devices 60. As a result, the temperature of the fluid can be increased or decreased as desired to facilitate moving shape deforming sealing element 40 from the run-in shape to the set shape. For example, fluid at a first temperature can be initially pumped down bore 28 through ports 29 and into interior area 38 of expandable element 30 causing expandable element 30 to expand or inflate to the expanded position. As peek pressure is achieved within interior area 38, pressure relief device(s) 60 are actuated allowing pressure, e.g., fluid within interior area 38 to be released. Therefore, new fluid, at a second, different, temperature, can be pumped into interior area 38.

In one embodiment, the temperature of the fluid being pumped into interior area 38 can be increased to the transition temperature of the material forming shape deforming sealing element 40. As the fluid flows into expandable element 30 and the transition temperature is reached, shape deforming sealing element 40 begins to move from the run-in shape toward the set shape. As a result, expandable element 30 continues to expand until shape deforming sealing element 40 reaches the set position, covers leak path 16, and is engaged with inner wall surface 16 of wellbore 10. Thereafter, fluid having a lower temperature can be pumped into interior area 38. This cooler fluid displaces the higher temperature fluid within interior area 38 by forcing the higher temperature fluid out of interior area 38 through pressure relief devices 60. Lowering the temperature of the fluid within interior area 38 below the transition temperature of the material forming shape deforming sealing element 40 causes shape deforming sealing element 40 to be retained in the set position. Accordingly, shape deforming sealing element 40 is sealed against and attached to inner wall surface 16 of wellbore 10, thereby sealing leak path 16.

As discussed above, sealing devices 20, 120 can be disposed within a wellbore using a conventional tubing string through which fluid is pumped or on electric wireline through-tubing. In the case of electric wireline through-tubing, an electric wireline setting tool can use fluid from the wellbore to be simultaneously heated by the setting tool and pumped into interior area 38 of the expandable element 30. Alternatively, the expandable element can have a battery powered or electric wireline powered heating element disposed within or in fluid communication with interior area 38 of expandable element 30. In another embodiment, the heating element can be operatively associated with shape deforming sealing element 40. Further, a spring-powered syringe pump can be coupled to the inlet of expandable element 30 to facilitate inflation or expansion of expandable element 30. As shape deforming sealing element 40 is heated and begins to deform, the decreasing modulus of shape deforming sealing element 40 allows expandable element 40 to expand via the stored energy in the spring.

It is to be understood that the invention is not limited to the exact details of construction, operation, exact materials, or embodiments shown and described, as modifications and equivalents will be apparent to one skilled in the art. For example, pressure relief devices are not required. Moreover, if a pressure relief device is included, only one can be sufficient to displace the fluid within the interior of the expandable element. In addition, one or more attachment members may be included on the outer wall surface of the shape deforming sealing element to facilitate the shape deforming sealing element maintaining its connection to the inner wall surface of the wellbore. Further, the sealing devices can be disposed in a wellbore using tubular strings as well as electric wireline strings. Additionally, the sealing devices can be used in open-hole or cased wellbores. Accordingly, the invention is therefore to be limited only by the scope of the appended claims.

What is claimed is:

1. A sealing device for use in a wellbore to seal a leak path through an inner wall surface of the wellbore, the sealing device comprising:

a tubular member comprising an outer wall surface and an inner wall surface;

an expandable element, the expandable element being disposed on the outer wall surface of the tubular member, the expandable element comprising an outer wall surface, a collapsed position, and an expanded position;

a shape deforming sealing element, the shape deforming sealing element comprising a run-in shape and a set shape, the shape deforming sealing element being releasably connected to the outer wall surface of the expandable element, the shape deforming element comprising an outer wall surface adapted to be secured to an inner wall surface of a wellbore when the shape deforming sealing element is in the set shape, a first fluid pumped into the expandable element at a first temperature, the first temperature being at or above a transition temperature for the shape deforming sealing element, and the first temperature facilitating the shape deforming sealing element deforming from the run-in shape to the set shape by raising the temperature of the sealing element to a transition temperature at which the sealing element is deformable by the expandable element to the set shape and below which the sealing element is not deformable to the set shape, wherein expansion of the expandable element using fluid pressure from the collapsed position to the expanded position moves the shape deforming sealing element from the run-in shape to the set shape, and wherein the shape deforming sealing element is adapted to be secured to the inner wall surface of the wellbore after collapsing the expandable element from the expanded position to the collapsed position.

2. The sealing device of claim 1, wherein the shape deforming sealing element comprises a sleeve disposed around the outer wall surface of the expandable element and the expandable element comprises an elastomeric bladder disposed around the outer wall surface of the tubular member.

3. The sealing device of claim 2, wherein the inner wall surface of the tubular member defines a tubular member bore, the tubular member further comprising a port in fluid communication with the tubular member bore and an interior of the elastomeric bladder, and the elastomeric bladder being moved from the collapsed position to the expanded position by a fluid flowing through the port into the interior of the elastomeric bladder.

4. The sealing device of claim 3, wherein the expandable element further comprises at least one pressure relief device in fluid communication with the interior portion of the expandable element.

5. The sealing device of claim 4, wherein the pressure relief device is a valve.

6. The sealing device of claim 5, wherein the pressure relief device is a one-way check valve.

7. The sealing device of claim 1, wherein the shape deforming sealing element is formed by a temperature reactive material, the temperature reactive material having a transition temperature at which the temperature reactive material is deformable and below which the temperature reactive material is not deformable.

8. The sealing device of claim 1, wherein the expandable support member comprises a slotted metal tubular member.

9. A sealing device for use in a wellbore to seal a leak path through an inner wall surface of the wellbore, the sealing device comprising:

a mandrel comprising an outer wall surface and an inner wall surface;

an expandable element sleeve, the expandable element sleeve being disposed on the outer wall surface of the mandrel, the expandable element sleeve comprising an outer wall surface, a collapsed position, and an expanded position;

a shape deforming sealing element sleeve, the shape deforming sealing element sleeve comprising a run-in inner diameter, a set inner diameter, and a plurality of intermediate inner diameters, the shape deforming sealing element sleeve comprising an inner wall surface and an outer wall surface adapted to be secured to an inner wall surface of a wellbore when the shape deforming sealing element sleeve is in the set shape; and a first fluid pumped into the expandable element sleeve at a first temperature, the first temperature being at or above a transition temperature for the shape deforming sealing element, and the first temperature facilitating the shape deforming sealing element deforming from the run-in shape to the set shape by raising the temperature of the sealing element to a transition temperature at which the sealing element is deformable by the expandable element to the set shape and below which the sealing element is not deformable to the set shape, wherein expansion of the expandable element sleeve from the collapsed position to the expanded position using fluid pressure moves the shape deforming sealing element sleeve from the run-in shape to the set shape, and wherein the shape deforming sealing element sleeve is adapted to be secured to the inner wall surface of the wellbore after collapsing the expandable element sleeve from the expanded position to the collapsed position.

10. The sealing device of claim 9, wherein the inner wall surface of the mandrel defines a mandrel bore and the expandable element sleeve comprises an elastomeric bladder, the mandrel further comprising a port in fluid communication with the mandrel bore and an interior of the elastomeric bladder, the elastomeric bladder being moved from the collapsed position to the expanded position by a fluid flowing through the port into the interior of the elastomeric bladder.

11. The sealing device of claim 10, wherein the expandable element sleeve further comprises at least one pressure relief device in fluid communication with the interior portion of the expandable element sleeve.

12. The sealing device of claim 9, wherein the shape deforming sealing element is formed by a temperature reactive material having a transition temperature at which the temperature reactive material is deformable and below which the temperature reactive material is not deformable.

13. The sealing device of claim 9, wherein the shape deforming sealing element sleeve comprises a shape memory polymeric material.

14. A method of sealing a leak path through an inner wall surface of a wellbore, the method comprising the steps of:

(a) providing a sealing device comprising:

a tubular member comprising an outer wall surface and an inner wall surface;

a shape deforming sealing element operatively associated with the outer wall surface of the tubular member, the shape deforming sealing element comprising a run-in shape and a set shape, the shape deforming sealing element comprising an inner wall surface and outer wall surface adapted to be secured to an inner wall surface of a wellbore when the shape deforming sealing element is in the set shape;

(b) disposing the sealing device in a wellbore aligning the shape deforming sealing element with a leak path in an inner wall surface of a wellbore;

(c) pumping a first fluid into an expandable element at a first temperature, the first temperature being at or above a transition temperature for the shape deforming sealing element, and the first temperature facilitating the shape deforming sealing element deforming from the run-in shape to the set shape by raising the temperature of the sealing element to a transition temperature at which the sealing element is deformable by the expandable element to the set shape and below which the sealing element is not deformable to the set shape, the expandable element being disposed on the outer wall surface of the tubular member and having an interior into which the first fluid is being pumped;

(d) moving the shape deforming sealing element from the run-in shape to the set shape using fluid pressure to cause the shape deforming sealing element to be secured to the inner wall surface over the leak path; and (e) removing the tubular member from the wellbore leaving the shape deforming sealing element in the wellbore.

15. The method of claim 14 further comprising the step of displacing the first fluid within the expandable element with a second fluid that is at a second temperature.

16. The method of claim 15 wherein the second temperature is lower than the first temperature and causes the shape deforming sealing element to remain in the set shape.

17. The method of claim 15, wherein the shape deforming sealing element is formed of a temperature reactive material having a transition temperature at which the temperature reactive material is deformable and below which the temperature reactive material is not deformable.

18. The method of claim 14, wherein the first fluid is a wellbore fluid that is heated while being pumped into the expandable element.

* * * * *